US011639593B2

(12) United States Patent
Meguriya et al.

(10) Patent No.: US 11,639,593 B2
(45) Date of Patent: May 2, 2023

(54) WORK MACHINE

(71) Applicant: HITACHI CONSTRUCTION MACHINERY CO., LTD., Tokyo (JP)

(72) Inventors: Shuuichi Meguriya, Ishioka (JP); Ryu Narikawa, Mito (JP); Hiroki Takeuchi, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 544 days.

(21) Appl. No.: 16/493,316

(22) PCT Filed: Aug. 24, 2018

(86) PCT No.: PCT/JP2018/031457

§ 371 (c)(1),
(2) Date: Sep. 12, 2019

(87) PCT Pub. No.: WO2019/054161

PCT Pub. Date: Mar. 21, 2019

(65) Prior Publication Data

US 2020/0032482 A1 Jan. 30, 2020

(30) Foreign Application Priority Data

Sep. 14, 2017 (JP) ..... JP2017-177200

(51) Int. Cl.
*E02F 9/20* (2006.01)
*E02F 3/43* (2006.01)
(Continued)

(52) U.S. Cl.
CPC ..... *E02F 9/2033* (2013.01); *E02F 3/435* (2013.01); *E02F 9/2004* (2013.01); *E02F 9/2246* (2013.01); *E02F 9/264* (2013.01)

(58) Field of Classification Search
CPC ..... E02F 9/2004; E02F 9/2033; E02F 9/2246; E02F 9/264; E02F 9/265; E02F 3/435
See application file for complete search history.

(56) References Cited

U.S. PATENT DOCUMENTS 5,752,333 A * 5/1998 Nakagawa ..... E02F 3/437 701/50
5,918,527 A * 7/1999 Haga ..... E02F 9/2025 91/363 R (Continued)

FOREIGN PATENT DOCUMENTS

JP 04-014531 A 1/1992
JP 04014531 A * 1/1992 ..... E02F 9/2033

(Continued)

OTHER PUBLICATIONS

International Search Report of PCT/JP2018/031457 dated Sep. 25, 2018.

(Continued)

*Primary Examiner* — Russell Frejd
*Assistant Examiner* — Sara J Lewandroski
(74) *Attorney, Agent, or Firm* — Mattingly & Malur, PC

(57) ABSTRACT

Provided is a work machine that can operate a front work implement at a speed according to an operator's lever operation while securing the accuracy of work by machine control. A hydraulic excavator 1 includes a controller 20 that sets a target surface for a bucket 10 and controls the operation of a front work implement 1B in such a manner that the bucket does not penetrate to below the target surface. The controller sets a speed correction region on an upper side of the target surface, varies a width R of the speed correction region in accordance with an operation amount of an operation device 15A or 15C, and controls the operation (Continued)

of the front work implement in such a manner that the work tool does not penetrate into the speed correction region.

4 Claims, 16 Drawing Sheets

(51) Int. Cl.
*E02F 9/22* (2006.01)
*E02F 9/26* (2006.01)

(56) References Cited

U.S. PATENT DOCUMENTS

2016/0215475 A1 7/2016 Meguriya et al.
2016/0251835 A1* 9/2016 Kitajima ..... E02F 3/3663 701/50
2016/0265187 A1* 9/2016 Baba ..... E02F 3/963
2017/0284070 A1* 10/2017 Matsuyama ..... E02F 9/2292
2021/0332566 A1* 10/2021 Shintani ..... G06F 3/14

FOREIGN PATENT DOCUMENTS

JP 09-053259 A 2/1997
WO WO-2016035898 A1 * 3/2016 ..... E02F 3/32

OTHER PUBLICATIONS

International Preliminary Report on Patentability received in corresponding International Application No. PCT/JP2018/031457 dated Mar. 26, 2020.
Supplementary European Search Report on received in corresponding International Application No. 18856259.9 dated Oct. 21, 2021.

* cited by examiner

WORK MACHINE

TECHNICAL FIELD

The present invention relates to a work machine such as a hydraulic excavator.

BACKGROUND ART

A hydraulic excavator includes a machine body including a lower track structure and an upper swing structure, and an articulated-type front work implement. The front work implement includes a boom rotatably mounted to a front portion of the upper swing structure, an arm mounted to a tip portion of the boom in a vertically rotatable manner, and a work tool (for example, a bucket) mounted to a tip portion of the arm in a vertically or front-rear directionally rotatable manner. The boom, the arm, and the bucket are driven by supplying a hydraulic fluid, delivered from a hydraulic pump driven by an engine, to a boom cylinder, an arm cylinder, and a bucket cylinder. With the boom cylinder, the arm cylinder, and the bucket cylinder driven according to lever operations by an operator, a desired operation of the front work implement is realized.

In addition, the hydraulic excavator includes one in which a function for automatically or semi-automatically operating the front work implement (the function will hereinafter be referred to machine control) is mounted. According to the machine control, it is easy, for example, to operate the front work implement in such a manner that the tip of the bucket is stopped on a target surface at the time of starting an operation such as excavation, or to operate the front work implement in such a manner that the tip of the bucket is moved along the target surface at the time of an arm crowding operation. Documents disclosing a prior art concerning machine control include, for example, Patent Document 1.

Patent Document 1 discloses a region limiting excavation controller for a construction machine including: a plurality of driven members inclusive of a plurality of front members which constitute an articulated-type front device (front work implement) and which are vertically rotatable; a plurality of hydraulic actuators that respectively drive the plurality of driven members; a plurality of operating means for instructing operations of the plurality of driven members; and a plurality of hydraulic control valves which are driven according to operation signals of the plurality of operating means and which control flow rates of a hydraulic fluid supplied to the plurality of hydraulic actuators. The region limiting excavation controller for the construction machine includes: region setting means for setting a region in which the front device can be moved; first detection means for detecting status quantities concerning position and posture of the front device; first calculation means for calculating the position and posture of the front device based on a signal from the first detection means; first signal correction means for performing a processing of reducing an operation signal of at least the operating means concerning a first specific front member of the plurality of operating means, when the front device is located in the set area and in a vicinity of a boundary of the region, based on a calculated value given by the first calculation means; mode selection means for selecting whether a processing of reducing the operation signal of the operating means by the first signal correction means is to be conducted; and second signal correction means for correcting the operation signal of at least the operating means concerning a second specific front member of the plurality of operating means, in such a manner that the front device is moved in a direction along the boundary of the set area and the moving speed in a direction for approaching the boundary of the set area is reduced, when the front device is located in the set area and in the vicinity of the boundary of the set area, based on the operation signal having undergone the processing of reducing by the first signal correction means and the calculated value given by the first calculation means in the case where it is selected by the mode selection means that the processing by the first signal correction means is to be conducted, and based on the operation signal of the operating means and the calculated value given by the first calculation means in the case where it is selected by the mode selection means that the processing by the first signal correction means is not to be conducted.

PRIOR ART DOCUMENT

Patent Document

Patent Document 1: JP-Hei-9-53259-A

SUMMARY OF THE INVENTION

Problems to be Solved by the Invention

According to the construction machine described in Patent Document 1, at the time of performing excavation with region limitation, it is possible to perform the work by selecting either of a work mode in which priority is given to accuracy such that the amount of penetration of the bucket tip into the outside of the set area is small (this mode will hereinafter referred to as accuracy priority mode) and a work mode in which priority is given to speed such that the front work implement can be moved fast (this mode will hereinafter referred to as speed priority mode) according to the operator's will. However, when the accuracy priority mode is selected, the amount of penetration of the bucket tip into the outside of the set area is suppressed, but the moving speed of the front work implement is reduced and, hence, the front work implement cannot be operated at a speed according to the operator's lever operation. On the other hand, when the speed priority mode is selected, the front work implement can be operated at a speed according to the operator's lever operation, but the amount of penetration of the bucket tip into the outside of the set area may be enlarged.

The present invention has been made in consideration of the above-mentioned problems. It is an object of the present invention to provide a work machine that can operate a front work implement at a speed according to an operator's lever operation, while securing the accuracy of work by machine control.

Means for Solving the Problems

In order to achieve the above object, according to the present invention, there is provided a work machine including: a machine body; an articulated-type work implement including a boom rotatably mounted to the machine body, an arm rotatably mounted to a tip portion of the boom, and a work tool rotatably mounted to the arm; a boom cylinder that drives the boom; an arm cylinder that drives the arm; a work tool cylinder that drives the work tool; an operation device for operating the work tool; and a controller that sets a target surface for the work tool, and controls an operation of the work implement in such a manner that the work tool does not penetrate to below the target surface, in which the controller sets a speed correction region on an upper side of the target surface, varies a width of the speed correction region in accordance with an operation amount of the operation device, and controls the operation of the work implement in such a manner that the work tool does not penetrate into the speed correction region.

According to the present invention configured as above, the speed correction region is set on the upper side of the target surface for the work tool, the width of the speed correction region is varied according to the operation amount of the operation device, and the operation of the front work implement is controlled in such a manner that the work tool does not penetrate into the speed correction region. As a result, it becomes possible to operate the front work implement at a speed according to the operator's lever operation, while securing the accuracy of work by machine control.

Advantages of the Invention

According to the present invention, a front work implement can be operated at a speed according to an operator's lever operation, while securing the accuracy of work by machine control.

MODE FOR CARRYING OUT THE INVENTION

Figure 1:
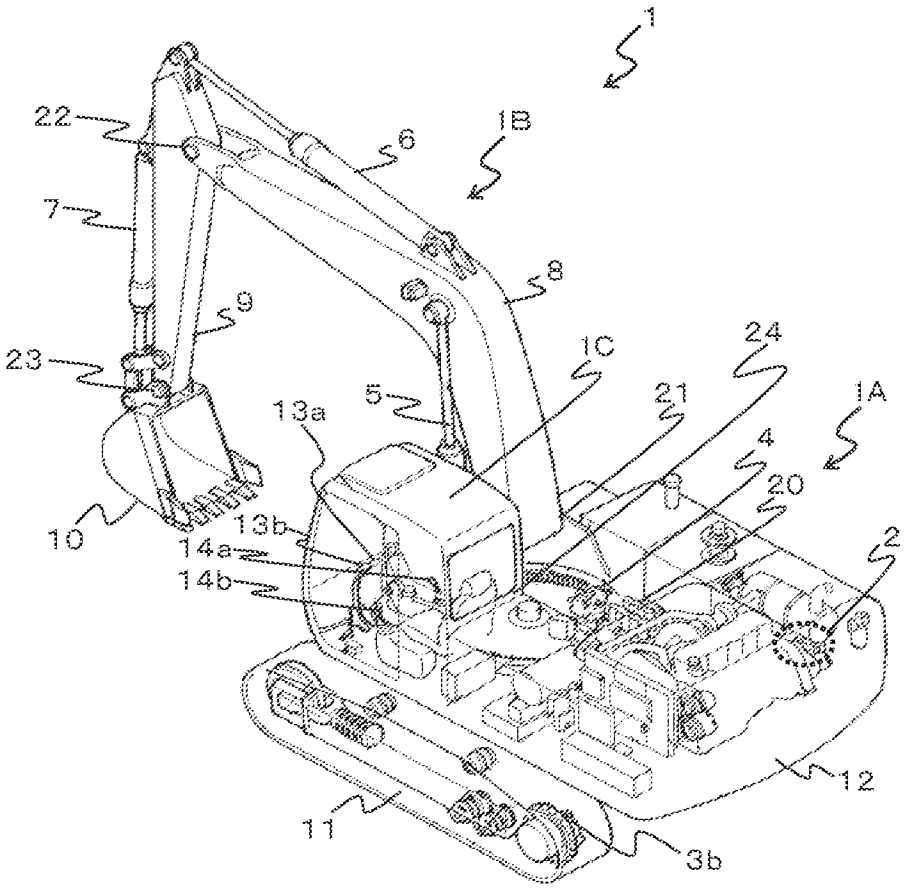
FIG. 1 is a perspective view of a hydraulic excavator according to an embodiment of the present invention.

A hydraulic excavator taken as an example of a work machine according to an embodiment of the present invention will be described below, referring to the drawings. Note that in the drawings, the same or equivalent members are denoted by the same reference characters, and repeated descriptions of them will be omitted.

FIG. 1 is a perspective view of a hydraulic excavator according to the present embodiment.

In FIG. 1, a hydraulic excavator 1 includes a machine body 1A, and an articulated-type front work implement 1B. The machine body 1A includes a lower track structure 11, and an upper swing structure 12 swingably mounted onto the lower track structure 11. The lower track structure 11 is driven to travel by a track right motor (not illustrated) and a track left motor 3*b*. The upper swing structure 12 is driven to swing by a swing hydraulic motor 4.

The front work implement 1B includes a boom 8 mounted to a front portion of the upper swing structure 12 in a vertically rotatable manner, an arm 9 mounted to a tip portion of the boom 8 rotatably vertically or in a front-rear direction, and a bucket (work tool) 10 mounted to a tip portion of the arm 9 rotatably vertically or in a front-rear direction. The boom 8 is rotated vertically by contracting/extending motions of a boom cylinder 5. The arm 9 is rotated vertically or in a front-rear direction by contracting/extending motions of an arm cylinder 6. The bucket 10 is rotated vertically or in a front-rear direction by contracting/extending motions of a bucket cylinder (work tool cylinder) 7.

An operation room 1C in which an operator rides is provided on a left side of a front portion of the upper swing structure 12. In the operation room 1C, there are disposed a track right lever 13*a* and a track left lever 13*b* for giving operation instructions to the lower track structure 11, and an operation right lever 14*a* and an operation left lever 14*b* for giving operation instructions to the boom 8, the arm 9, the bucket 10, and the upper swing structure 12.

A boom angle sensor 21 for detecting a rotation angle of the boom 8 is attached to a boom pin that links the boom 8 to the upper swing structure 12. An arm angle sensor 22 for detecting a rotation angle of the arm 9 is attached to an arm pin that links the arm 9 to the boom 8. A bucket angle sensor 23 for detecting a rotation angle of the bucket 10 is attached to a bucket pin that links the bucket 10 to the arm 9. A machine body inclination angle sensor 24 for detecting an inclination angle in the front-rear direction of the upper swing structure 12 (machine body 1A) relative to a reference plane (for example, a horizontal plane) is attached to the upper swing structure 12. Angle signals outputted from the angle sensors 21 to 23 and the machine body inclination angle sensor 24 are inputted to a controller 20 (depicted in FIG. 2) which will be described later.

Figure 2:
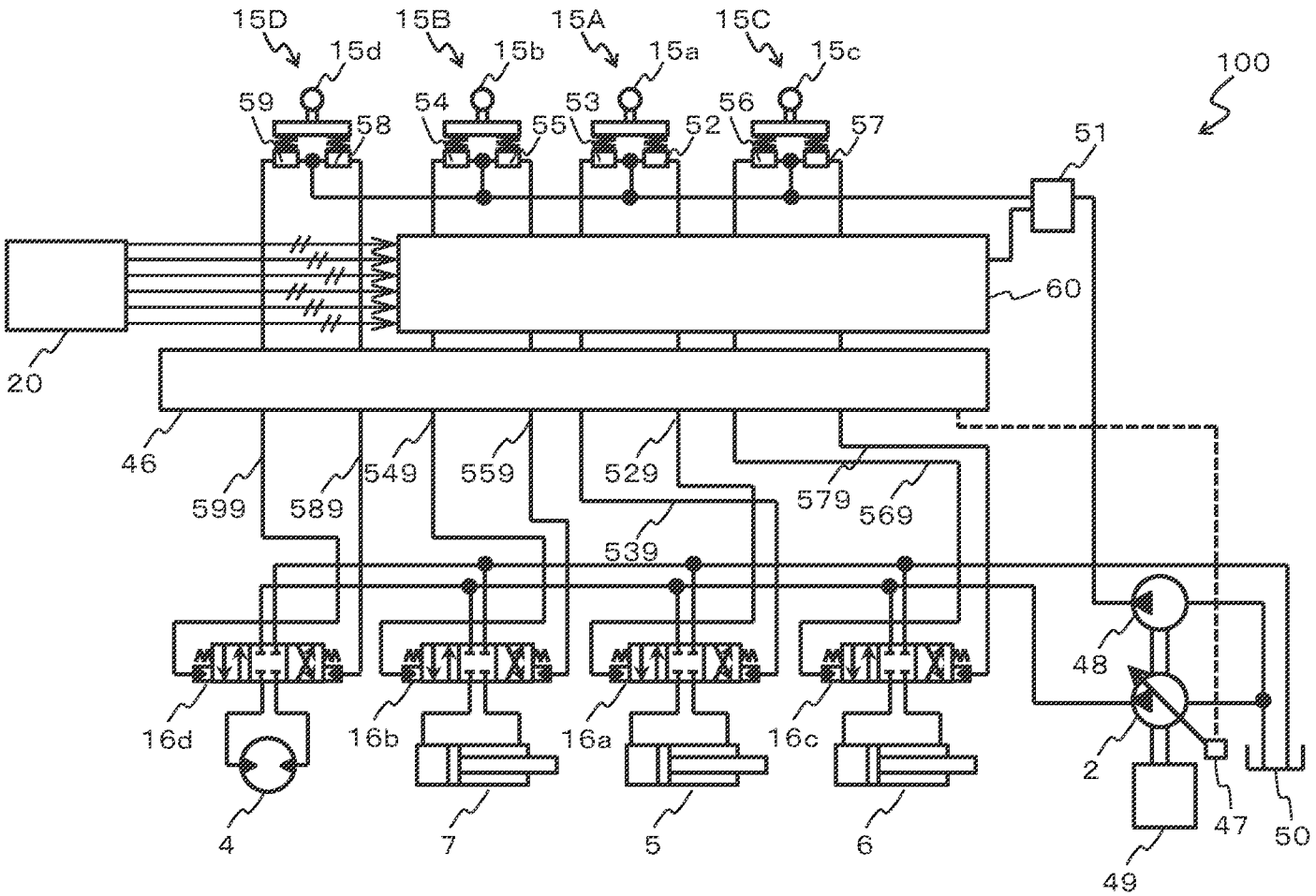
FIG. 2 is a schematic configuration diagram of a hydraulic drive system mounted on the hydraulic excavator depicted in FIG. 1.

FIG. 2 is a schematic configuration diagram of a hydraulic drive system mounted on the hydraulic excavator 1 depicted in FIG. 1. Note that for simplification of explanation, in FIG. 2, only portions concerning the driving of the boom cylinder 5, the arm cylinder 6, the bucket cylinder 7, and the swing hydraulic motor 4 are depicted, and portions concerning the driving of other hydraulic actuators are omitted.

In FIG. 2, the hydraulic drive system 100 includes the hydraulic actuators 4 to 7, a prime mover 49, the hydraulic pump 2 and a pilot pump 48 driven by the prime mover 49, flow control valves 16*a* to 16*d* for controlling the directions and flow rates of a hydraulic fluid supplied from the hydraulic pump 2 to the hydraulic actuators 4 to 7, hydraulic pilot type operation devices 15A to 15D for operating the flow control valves 16*a* to 16*d*, a hydraulic control unit 60, a shuttle block 46, and the controller 20 as a control system.

The hydraulic pump 2 includes a tilting swash plate mechanism (not illustrated) that has a pair of input/output ports, and a regulator 47 for regulating the tilting angle of a swash plate to regulate the pump displacement volume. The regulator 47 is operated by a pilot pressure supplied from the shuttle block 46 described later.

The pilot pump 48 is connected to pilot pressure control valves 52 to 59 and the hydraulic control unit 60, which will be described later, through a lock valve 51. The lock valve 51 is opened and closed in accordance with an operation of a gate lock lever (not illustrated) provided in the vicinity of an entrance to the operation room 1C. When the gate lock lever is operated to a position (push-down position) for restricting the entrance to the operation room 1C, the lock valve 51 is opened by an instruction from the controller 20. As a result, a delivery pressure of the pilot pump 48 (hereinafter referred to as pilot primary pressure) is supplied to the pilot pressure control valves 52 to 59 and the hydraulic control unit 60, resulting in that operations of the flow control valves 16*a* to 16*d* by the operation devices 15A to 15D are possible. On the other hand, when the gate lock lever is operated to a position (push-up position) for opening the entrance to the operation room 1C, the lock valve 51 is closed by an instruction from the controller 20. As a result, the supply of the pilot primary pressure from the pilot pump 48 to the pilot pressure control valves 52 to 59 and the hydraulic control unit 60 is stopped, resulting in that the operations of the flow control valves 16*a* to 16*d* by the operation devices 15A to 15D are impossible.

The operation device 15A includes a boom operation lever 15*a*, the boom raising pilot pressure control valve 52, and the boom lowering pilot pressure control valve 53. Here, the boom operation lever 15*a* corresponds, for example, to the operation right lever 14*a* (depicted in FIG. 1) when it is operated in the front-rear direction.

The boom raising pilot pressure control valve 52 decompresses the pilot primary pressure supplied through the lock valve 51, to produce a pilot pressure according to a lever stroke (hereinafter referred to as operation amount) in the boom raising direction of the boom operation lever 15*a* (this pilot pressure will hereinafter be referred to as boom raising pilot pressure). The boom raising pilot pressure outputted from the boom raising pilot pressure control valve 52 is led to an operation section on one side (the left side in the figure) of the boom flow control valve 16*a* through the hydraulic control unit 60, the shuttle block 46, and a pilot line 529, to drive the boom flow control valve 16*a* in the rightward direction in the figure. As a result, the hydraulic fluid delivered from the hydraulic pump 2 is supplied to the bottom side of the boom cylinder 5, whereas the hydraulic fluid on the rod side is discharged into a tank 50, and the boom cylinder 5 is extended.

The boom lowering pilot pressure control valve 53 decompresses the pilot primary pressure supplied through the lock valve 51, to produce a pilot pressure according to an operation amount in the boom lowering direction of the boom operation lever 15*a* (this pilot pressure will hereinafter be referred to as boom lowering pilot pressure). The boom lowering pilot pressure outputted from the boom lowering pilot pressure control valve 53 is led to an operation section on the other side (the right side in the figure) of the boom flow control valve 16*a* through the hydraulic control unit 60, the shuttle block 46, and a pilot line 539, to drive the boom flow control valve 16*a* in the leftward direction in the figure. As a result, the hydraulic fluid delivered from the hydraulic pump 2 is supplied to the rod side of the boom cylinder 5, whereas the hydraulic fluid on the bottom side is discharged into the tank 50, and the boom cylinder 5 is contracted.

The operation device 15B includes the bucket operation lever (work tool operation lever) 15*b*, the bucket crowding pilot pressure control valve 54, and the bucket dumping pilot pressure control valve 55. Here, the bucket operation lever 15*b* corresponds, for example, to the operation right lever 14*a* (depicted in FIG. 1) when it is operated in the left-right direction.

The bucket crowding pilot pressure control valve 54 decompresses the pilot primary pressure supplied through the lock valve 51, to produce a pilot pressure according to an operation amount in the bucket crowding direction of the bucket operation lever 15*b* (this pilot pressure will hereinafter be referred to as bucket crowding pilot pressure). The bucket crowding pilot pressure outputted from the bucket crowding pilot pressure control valve 54 is led to an operation section on one side (left side in the figure) of the bucket flow control valve 16*b* through the hydraulic control unit 60, the shuttle block 46, and a pilot line 549, to drive the bucket flow control valve 16*b* in the rightward direction in the figure. As a result, the hydraulic fluid delivered from the hydraulic pump 2 is supplied to the bottom side of the bucket cylinder 7, whereas the hydraulic fluid on the rod side is discharged into the tank 50, and the bucket cylinder 7 is extended.

The bucket dumping pilot pressure control valve 55 decompresses the pilot primary pressure supplied through the lock valve 51, to produce a pilot pressure according to an operation amount in the bucket dumping direction of the bucket operation lever 15*b* (this pilot pressure will hereinafter be referred to as bucket dumping pilot pressure). The bucket dumping pilot pressure outputted from the bucket dumping pilot pressure control valve 55 is led to an operation section on the other side (the right side in the figure) of the bucket flow control valve 16*b* through the hydraulic control unit 60, the shuttle block 46, and a pilot line 559, to drive the bucket flow control valve 16*b* in the leftward direction in the figure. As a result, the hydraulic fluid delivered from the hydraulic pump 2 is supplied to the rod side of the arm cylinder 6, whereas the hydraulic fluid on the bottom side is discharged into the tank 50, and the bucket cylinder 7 is contracted.

The operation device 15C includes an arm operation lever 15*c*, the arm crowding pilot pressure control valve 56, and the arm dumping pilot pressure control valve 57. Here, the arm operation lever 15*c* corresponds, for example, to the operation left lever 14*b* (depicted in FIG. 1) when it is operated in the left-right direction.

The arm crowding pilot pressure control valve 56 decompresses the pilot primary pressure supplied through the lock valve 51, to produce s pilot pressure according to an operation amount in the arm crowding direction of the arm operation lever 15*c* (this pilot pressure will hereinafter be referred to as arm crowding pilot pressure). The arm crowding pilot pressure outputted from the arm crowding pilot pressure control valve 56 is led to an operation section on one side (the left side in the figure) of the arm flow control valve 16*c* through the hydraulic control unit 60, the shuttle block 46, and a pilot line 569, to drive the arm flow control valve 16*c* in the rightward direction in the figure. As a result, the hydraulic fluid delivered from the hydraulic pump 2 is supplied to the bottom side of the arm cylinder 6, whereas the hydraulic fluid on the rod side is discharged into the tank 50, and the arm cylinder 6 is extended.

The arm dumping pilot pressure control valve 57 decompresses the pilot primary pressure supplied through the lock valve 51, to produce a pilot pressure according to an operation amount in the arm dumping direction of the arm operation lever 15*c* (this pilot pressure will hereinafter be referred to as arm dumping pilot pressure). The arm dumping pilot pressure outputted from the arm dumping pilot pressure control valve 57 is led to the operation section of the other side (the right side in the figure) of the arm flow control valve 16*c* through the hydraulic control unit 60, the shuttle block 46, and a pilot line 579, to drive the arm flow control valve 16*c* in the leftward direction in the figure. As a result, the hydraulic fluid delivered from the hydraulic pump 2 is supplied to the rod side of the arm cylinder 6, whereas the hydraulic fluid on the bottom side is discharged into the tank 50, and the arm cylinder 6 is contracted.

The operation device 15D includes a swing operation lever 15*d*, the right swing pilot pressure control valve 58, and the left swing pilot pressure control valve 59. Here, the swing operation lever 15*d* corresponds, for example, to the operation left lever 14*b* (depicted in FIG. 1) when it is operated in the front-rear direction.

The right swing pilot pressure control valve 58 decompresses the pilot primary pressure supplied through the lock valve 51, to produce a pilot pressure according to an operation amount in the right swing direction of the swing operation lever 15*d* (this pilot pressure will hereinafter be referred to as right swing pilot pressure). The right swing pilot pressure outputted from the right swing pilot pressure control valve 58 is led to the operation section of one side (the right side in the figure) of the swing flow control valve 16*d* through the hydraulic control unit 60, the shuttle block 46, and a pilot line 589, to drive the swing flow control valve 16*d* in the leftward direction in the figure. As a result, the hydraulic fluid delivered from the hydraulic pump 2 flows into the inlet/outlet port on one side (the right side in the figure) of the swing hydraulic motor 4, whereas the hydraulic fluid flowing out from the inlet/outlet port on the other side (the left side in the figure) is discharged into the tank 50, and the swing hydraulic motor 4 is rotated in one direction (a direction for putting the upper swing structure 12 into right swing).

The left swing pilot pressure control valve 59 decompresses the pilot primary pressure supplied through the lock valve 51, to produce a pilot pressure according to an operation amount in the left swing direction of the swing operation lever 15*d* (this pilot pressure will hereinafter be referred to as left swing pilot pressure). The left swing pilot pressure outputted from the left swing pilot pressure control valve 59 is led to an operation section on the other side (the left side in the figure) of the swing flow control valve 16*d* through the hydraulic control unit 60, the shuttle block 46, and a pilot line 599, to drive the swing flow control valve 16*d* in the rightward direction in the figure. As a result, the hydraulic fluid delivered from the hydraulic pump 2 flows into the inlet/outlet port on the other side (the left side in the figure) of the swing hydraulic motor 4, whereas the hydraulic fluid flowing out from the inlet/outlet port on one side (the right side in the figure) is discharged into the tank 50, and the swing hydraulic motor 4 is rotated in the other direction (a direction for putting the upper swing structure 12 into left swing).

The hydraulic control unit 60 is a device for executing a machine control, corrects the pilot pressures inputted from the pilot pressure control valves 52 to 59 according to instructions from the controller 20, and outputs the corrected pilot pressures to the shuttle block 46. As a result, it is possible to cause the front work implement 1B to perform a desired operation, irrespectively of the operator's lever operation.

The shuttle block 46 outputs the pilot pressures inputted from the hydraulic control block to the pilot lines 529, 539, 549, 559, 569, 579, 589, and 599, selects, for example, a maximum pilot pressure of the inputted pilot pressures, and outputs the maximum pilot pressure to the regulator 47 of the hydraulic pump 2. As a result, the delivery flow rate of the hydraulic pump 2 can be controlled according to the operation amounts of the operation levers 15*a* to 15*d*.

Figure 3:
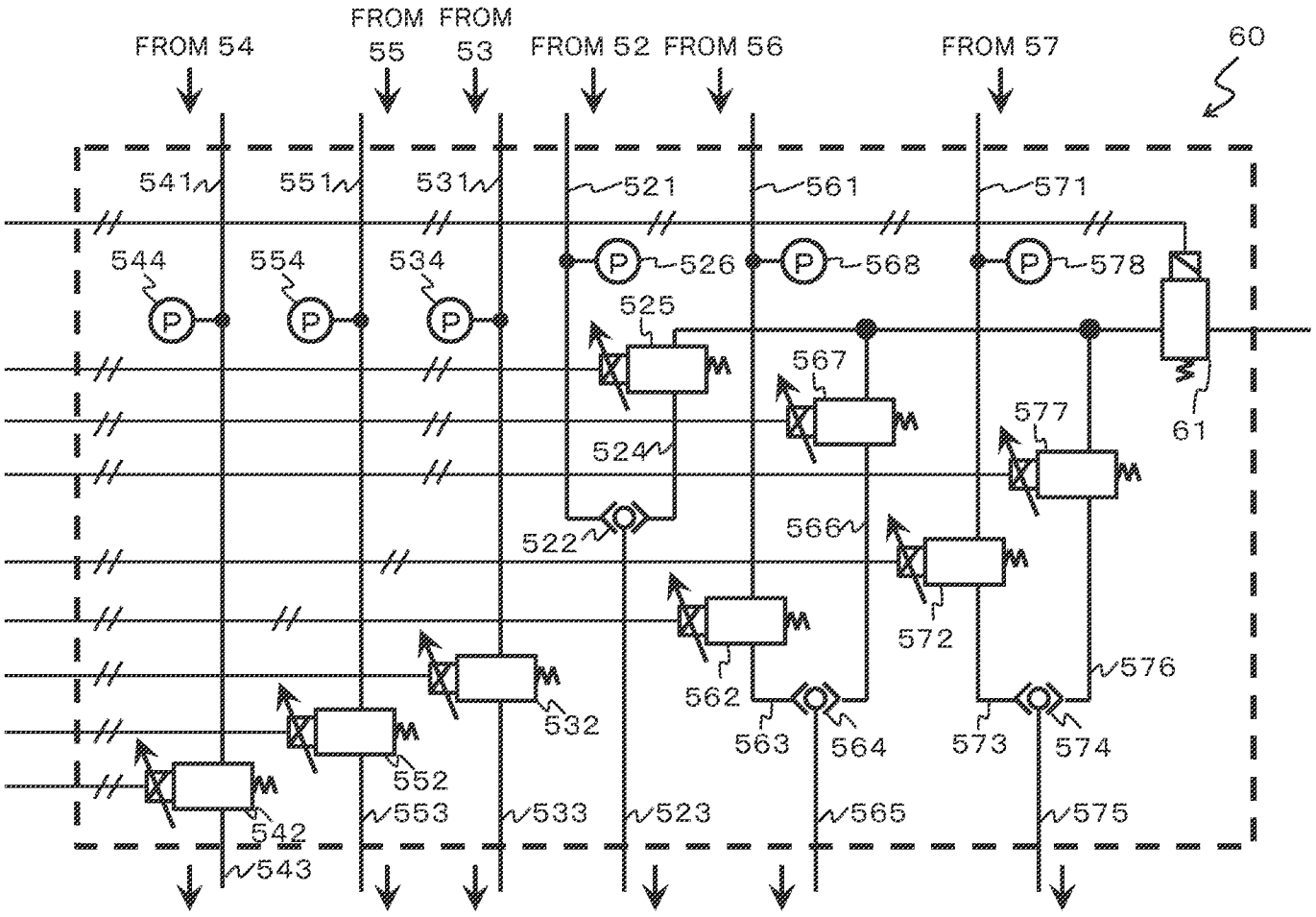
FIG. 3 is a configuration diagram of a hydraulic control unit depicted in FIG. 2.

FIG. 3 is a configuration diagram of the hydraulic control unit 60 depicted in FIG. 2.

In FIG. 3, the hydraulic control unit 60 includes a solenoid shut-off valve 61, shuttle valves 522, 564, and 574, and solenoid proportional valves 525, 532, 542, 552, 562, 567, 572, and 577.

An inlet port of the solenoid shut-off valve 61 is connected to an outlet port of the lock valve 51 (depicted in FIG. 2). An outlet port of the solenoid shut-off valve 61 is connected to inlet ports of the solenoid proportional valves 525, 567, and 577. Of the solenoid shut-off valve 61, the opening is zero when no current is passed, and the opening is maximized by the supply of current from the controller 20. In the case of making the machine control valid, the opening of the solenoid shut-off valve 61 is maximized, and the supply of the pilot primary pressure to the solenoid proportional valves 525, 567, and 577 is started. On the other hand, in the case of making the machine control invalid, the opening of the solenoid shut-off valve 61 is set to zero, and the supply of the pilot primary pressure to the solenoid proportional valves 525, 567, and 577 is stopped.

The shuttle valve 522 has two inlet ports and one outlet port, and the higher one of pressures inputted from the two inlet ports is outputted from the outlet port. The inlet port on one side of the shuttle valve 522 is connected to the boom raising pilot pressure control valve 52 through a pilot line 521. The inlet port on the other side of the shuttle valve 522 is connected to an outlet port of the solenoid proportional valve 525 through a pilot line 524. The outlet port of the shuttle valve 522 is connected to the shuttle block 46 through a pilot line 523.

An inlet port of the solenoid proportional valve 525 is connected to the outlet port of the solenoid shut-off valve 61. The outlet port of the solenoid proportional valve 525 is connected to the inlet port on the other side of the shuttle valve 522 through a pilot line 524. Of the solenoid proportional valve 525, the opening is set to zero when no current is passed, and the opening is increased according to a current supplied from the controller 20. The solenoid proportional valve 525 decompresses the pilot primary pressure supplied through the solenoid shut-off valve 61 in accordance with the opening thereof, and outputs the decompressed pilot pressure to the pilot line 524. As a result, a boom raising pilot pressure can be supplied to the pilot line 523 even in the case where the boom raising pilot pressure is not supplied from the boom raising pilot pressure control valve 52 to the pilot line 521. Note that in the case where the machine control with respect to a boom raising operation is not conducted, the solenoid proportional valve 525 is set into a non-current-passed state, and the opening of the solenoid proportional valve 525 is set to zero. In this instance, the boom raising pilot pressure supplied from the boom raising pilot pressure control valve 52 is led to an operation section on one side of the boom flow control valve 16*a*, and, therefore, a boom raising operation according to an operator's lever operation can be performed.

An inlet port of the solenoid proportional valve 532 is connected to the boom lowering pilot pressure control valve 53 through a pilot line 531. An outlet port of the solenoid proportional valve 532 is connected to the shuttle block 46 through a pilot line 533. Of the solenoid proportional valve 532, the opening is maximized when no current is passed, and the opening is reduced from the maximum to zero according to a current supplied from the controller 20. The solenoid proportional valve 532 decompresses the boom lowering pilot pressure supplied through the pilot line 531 in accordance with the opening thereof, and outputs the decompressed pilot pressure to the pilot line 533. As a result, it is possible to decompress, or reduce to zero, the boom lowering pilot pressure due to an operator's lever operation. Note that in the case where the machine control with respect to a boom lowering operation is not conducted, the solenoid proportional valve 532 is set into a non-current-passed state, and the opening of the solenoid proportional valve 532 is full open. In this instance, the boom lowering pilot pressure supplied from the boom lowering pilot pressure control valve 53 is led to an operation section on the other side of the boom flow control valve 16*a*, and, therefore, a boom lowering operation according to an operator's lever operation can be performed.

An inlet port of the solenoid proportional valve 542 is connected to the bucket crowding pilot pressure control valve 54 through a pilot line 541. An outlet port of the solenoid proportional valve 542 is connected to the shuttle block 46 through a pilot line 543. Of the solenoid proportional valve 542, the opening is maximized when no current is passed, and the opening is reduced from the maximum to zero in accordance with a current supplied from the controller 20. The solenoid proportional valve 542 decompresses the bucket crowding pilot pressure inputted through the pilot line 541 in accordance with the opening thereof, and outputs the decompressed pilot pressure to the pilot line 543. As a result, it is possible to decompress, or to reduce to zero, the bucket crowding pilot pressure due to an operator's lever operation. Note that in the case where the machine control with respect to a bucket crowding operation is not conducted, the solenoid proportional valve 542 is set into a non-current-passed state, and the opening of the solenoid proportional valve 542 is full open. In this instance, the bucket crowding pilot pressure supplied from the bucket crowding pilot pressure control valve 54 is led to an operation section on one side of the bucket flow control valve 16*b*, and, therefore, a bucket dumping operation according an operator's lever operation can be performed.

An inlet port of the solenoid proportional valve 552 is connected to the bucket dumping pilot pressure control valve 55 through a pilot line 551. An outlet port of the solenoid proportional valve 552 is connected to the shuttle block 46 (depicted in FIG. 2) through a pilot line 553. Of the solenoid proportional valve 552, the opening is maximized when no current is passed, and the opening is reduced from the maximum to zero according to a current supplied from the controller 20. The solenoid proportional valve 552 decompresses the bucket dumping pilot pressure inputted through the pilot line 551 in accordance with the opening thereof, and outputs the decompressed pilot pressure to the pilot line 553. As a result, it is possible to decompress, or to reduce to zero, the bucket dumping pilot pressure due to an operator's lever operation. Note that in the case where the machine control with respect to a bucket dumping operation is not conducted, the solenoid proportional valve 552 is set into a non-current-passed state, and the opening of the solenoid proportional valve 552 is full open. In this instance, the bucket dumping pilot pressure supplied from the bucket dumping pilot pressure control valve 55 is led to an operation section on the other side of the bucket flow control valve 16*b*, and, therefore, a bucket dumping operation according to an operator's lever operation can be performed.

The shuttle valve 564 has two inlet ports and one outlet port, and a higher one of pressures inputted from the two inlet ports is outputted from the output port. The inlet port on one side of the shuttle valve 564 is connected to an outlet port of the solenoid proportional valve 562 through a pilot line 563. The inlet port on the other side of the shuttle valve 564 is connected to an outlet port of the solenoid proportional valve 567 through a pilot line 566. The outlet port of the shuttle valve 522 is connected to the shuttle block 46 through a pilot line 565.

An inlet port of the solenoid proportional valve 562 is connected to the arm crowding pilot pressure control valve 56 through a pilot line 561. An outlet port of the solenoid proportional valve 562 is connected to the inlet port on one side of the shuttle valve 564 through the pilot line 563. Of the solenoid proportional valve 562, the opening is maximized when no current is passed, and the opening is reduced from the maximum to zero according to a current supplied from the controller 20. The solenoid proportional valve 562 decompresses the arm crowding pilot pressure inputted through the pilot line 561 in accordance with the opening thereof, and outputs the decompressed pilot pressure to the pilot line 563. As a result, it is possible to decompress, or to reduce to zero, the arm crowding pilot pressure due to an operator's lever operation.

An inlet port of the solenoid proportional valve 567 is connected to the output port of the solenoid shut-off valve 61, and an outlet port of the solenoid proportional valve 567 is connected to the inlet port on the other side of the shuttle valve 564 through a pilot line 566. Of the solenoid proportional valve 567, the opening is set to zero when no current is passed, and the opening is increased according to a current supplied from the controller 20. The solenoid proportional valve 567 decompresses the pilot primary pressure supplied through the solenoid shut-off valve 61 in accordance with the opening thereof, and outputs the decompressed pilot pressure to the pilot line 566. As a result, even in the case where the arm crowding pilot pressure is not supplied from the arm crowding pilot pressure control valve 56 to the pilot line 563, the arm crowding pilot pressure can be supplied to the pilot line 565. Note that in the case where the machine control with respect to an arm crowding operation is not conducted, the solenoid proportional valves 562 and 567 are set into a non-current-passed state, the opening of the solenoid proportional valve 562 is full open, and the opening of the solenoid proportional valve 567 is zero. In this instance, the arm crowding pilot pressure supplied from the arm crowding pilot pressure control valve 56 is led to an operation section on one side of the arm flow control valve 16*c*, and, therefore, an arm crowding operation according to an operator's lever operation can be performed.

The shuttle valve 574 has two inlet ports and one outlet port, and the higher one of pressures inputted from the two inlet ports is outputted from the outlet port. The inlet port on one side of the shuttle valve 574 is connected to an outlet port of the solenoid proportional valve 572 through a pilot line 573. The inlet port on the other side of the shuttle valve 574 is connected to an outlet port of the solenoid proportional valve 577 through a pilot line 576. The outlet port of the shuttle valve 574 is connected to the shuttle block 46 through a pilot line 575.

An inlet port of the solenoid proportional valve 572 is connected to the arm dumping pilot pressure control valve 57 through a pilot line 571. The outlet port of the solenoid proportional valve 572 is connected to the inlet port on one side of the shuttle valve 574 through the pilot line 573. Of the solenoid proportional valve 572, the opening is maximized when no current is passed, and the opening is reduced from the maximum to zero according to a current supplied from the controller 20. The solenoid proportional valve 572 decompresses the arm dumping pilot pressure inputted through the pilot line 571 in accordance with the opening thereof, and supplies the decompressed pilot pressure to the pilot line 573. As a result, it is possible to decompress, or to reduce to zero, the arm dumping pilot pressure due to an operator's lever operation.

An inlet port of the solenoid proportional valve 577 is connected to the outlet port of the solenoid shut-off valve 61. An outlet port of the solenoid proportional valve 577 is connected to the inlet port on the other side of the shuttle valve 574 through a pilot line 576. Of the solenoid proportional valve 577, the opening is set to zero when no current is passed, and the opening is increased according to a current supplied from the controller 20. The solenoid proportional valve 577 decompresses the pilot primary pressure supplied through the solenoid shut-off valve 61 in accordance with the opening thereof, and supplies the decompressed pilot pressure to the pilot line 576. As a result, even in the case where the arm dumping pilot pressure is not supplied from the arm dumping pilot pressure control valve 57 to the pilot line 573, the arm dumping pilot pressure can be supplied to the pilot line 575. Note that in the case where the machine control with respect to an arm dumping operation is not conducted, the solenoid proportional valves 572 and 577 are set into a non-current-passed state, the opening of the solenoid proportional valve 572 is full open, and the opening of the solenoid proportional valve 577 is zero. In this instance, the arm dumping pilot pressure supplied from the arm dumping pilot pressure control valve 57 is led to an operation section on the other side of the arm flow control valve 16*c*, and, therefore, an arm dumping operation according to an operator's lever operation can be performed.

The pilot line 521 is provided with a pressure sensor 526 for detecting the boom raising pilot pressure supplied from the boom raising pilot pressure control valve 52. The pilot line 531 is provide with a pressure sensor 534 for detecting the boom lowering pilot pressure supplied from the boom lowering pilot pressure control valve 53. The pilot line 541 is provide with a pressure sensor 544 for detecting the bucket crowding pilot pressure supplied from the bucket crowding pilot pressure control valve 54. The pilot line 551 is provided with a pressure sensor 554 for detecting the bucket dumping pilot pressure supplied from the bucket dumping pilot pressure control valve 55. The pilot line 561 is provided with a pressure sensor 568 for detecting the arm crowding pilot pressure supplied from the arm crowding pilot pressure control valve 56. The pilot line 571 is provided with a pressure sensor 578 for detecting the arm dumping pilot pressure supplied from the arm dumping pilot pressure control valve 57. The pilot pressures detected by the pressure sensors 526, 534, 544, 554, 568, and 578 are inputted to the controller 20 as operation signals.

Figure 4:
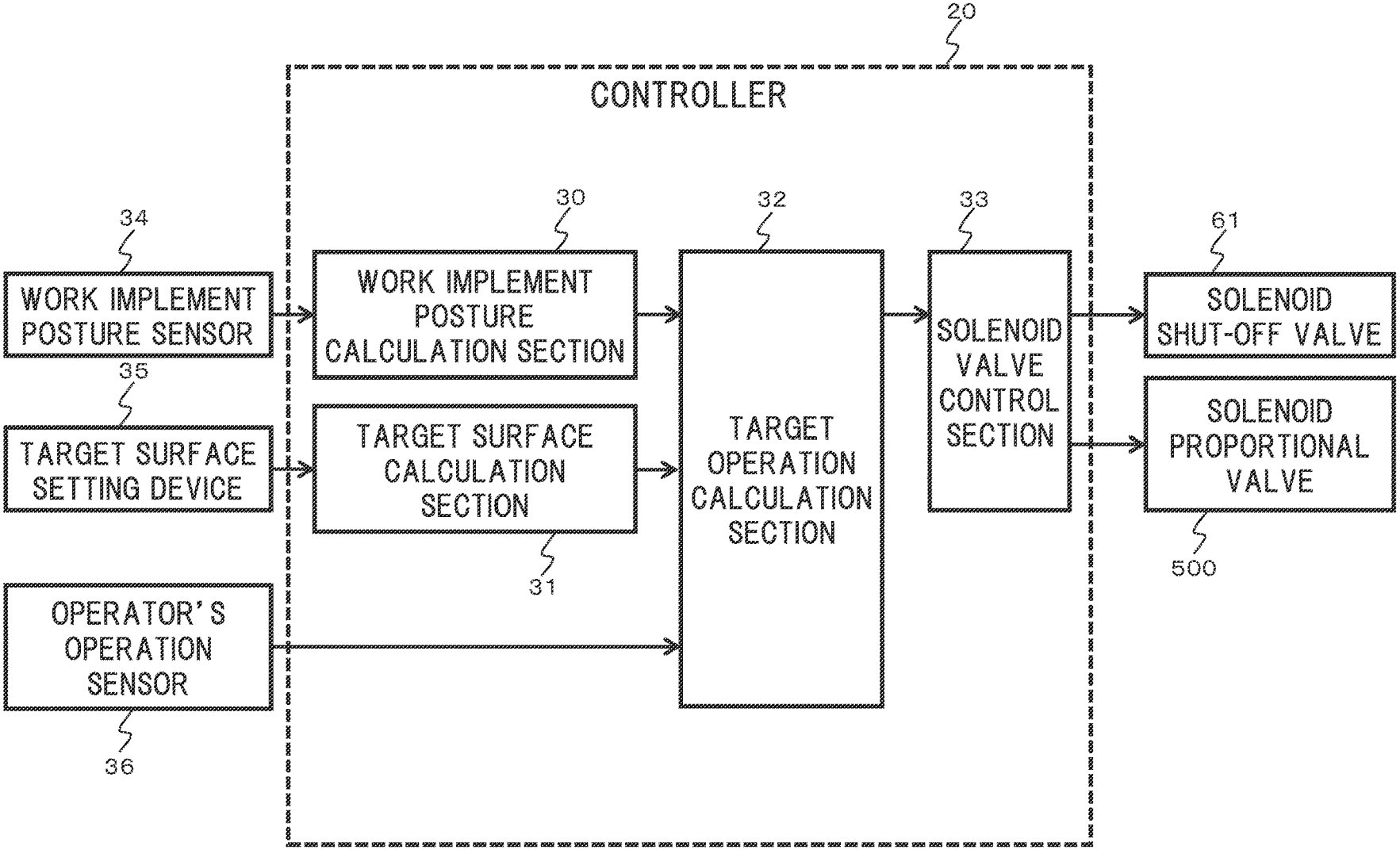
FIG. 4 is a functional block diagram of a controller depicted in FIG. 2.

FIG. 4 is a functional block diagram of the controller depicted in FIG. 2.

In FIG. 4, the controller 20 includes a work implement posture calculation section 30, a target surface calculation section 31, a target operation calculation section 32, and a solenoid valve control section 33.

The work implement posture calculation section 30 calculates the posture of the front work implement 1B based on information from a work implement posture sensor 34. Here, the work implement posture sensor 34 includes the boom angle sensor 21, the arm angle sensor 22, the bucket angle sensor 23, and the machine body inclination angle sensor 24.

The target surface calculation section 31 calculates a target surface based on information from a target surface setting device 35. Here, the target surface setting device 35 is an interface through which information regarding the target surface can be inputted. The input to the target surface setting device 35 may be manually made by the operator, or may be taken in from the exterior via a network or the like. In addition, a satellite communication antenna may be connected to the target surface setting device 35, and the position of the hydraulic excavator 1 and a target surface position in a global coordinate system may be calculated.

The target operation calculation section 32 calculates a target operation of the front work implement 1B in such a manner that the bucket 10 is moved without penetrating into the target surface, based on information from the work implement posture calculation section 30, the target surface calculation section 31, and an operator's operation sensor 36. Here, the operator's operation sensor 36 includes the pressure sensors 526, 534, 544, 554, 568, and 578 (depicted in FIG. 3).

The solenoid valve control section 33 outputs instructions to the solenoid shut-off valve 61 and a solenoid proportional valve 500, based on information from the target operation calculation section 32. Here, the solenoid proportional valve 500 is representative of the solenoid proportional valves 525, 532, 542, 552, 562, 567, 572, and 577 (depicted in FIG. 3).

Figure 5:
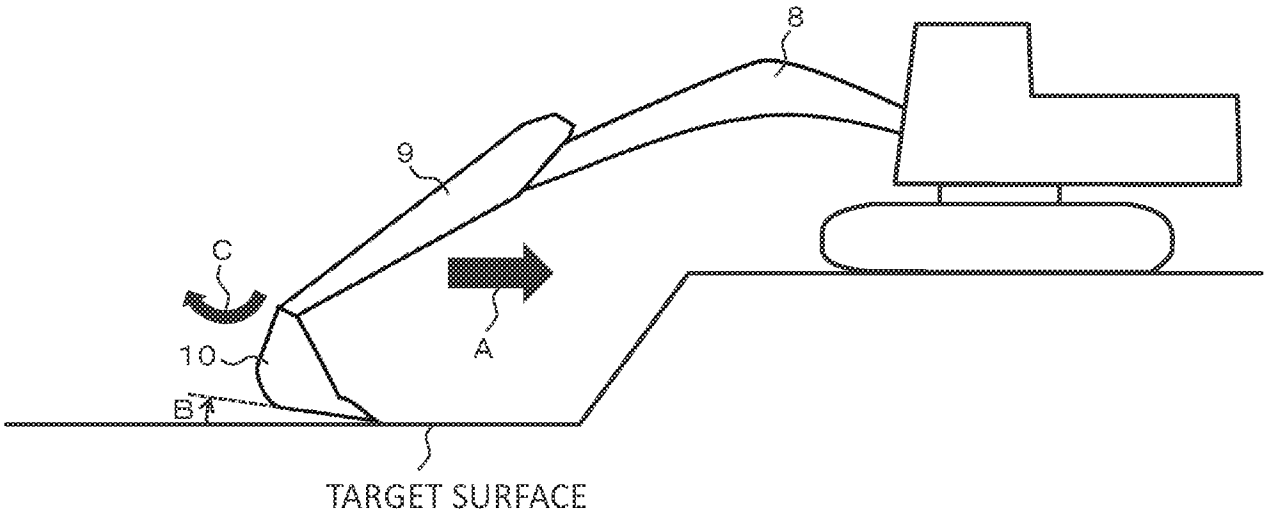
FIG. 5 is a figure depicting an example of a horizontal excavating operation by a machine control.

An example of a horizontal excavating operation by machine control is depicted in FIG. 5. For example, in the case where the operator operates the operation device 15 to perform horizontal excavation by a pulling operation of the arm 9 in the direction of arrow A, the solenoid proportional valve 525 is controlled to automatically perform a raising operation of the boom 8 in such a manner that the tip of the bucket 10 does not penetrate to below a target surface. In addition, in the case where the bucket 10 has penetrated to below the target surface at the time of performing horizontal excavation by the pulling operation of the arm 9 in the direction of arrow A, the solenoid proportional valve 525 is controlled to automatically perform the raising operation of the boom 8 in such a manner that the bucket 10 returns to above the target surface. In addition, in the case where the bucket 10 is brought close to the target surface by a lowering operation of the boom 8, the solenoid proportional valve 532 is controlled such as to reduce the speed of the boom 8 in such a manner that the bucket 10 does not penetrate to below the target surface, and to reduce the speed of the boom 8 to zero in a state in which the bucket 10 reaches the target surface. In addition, the solenoid proportional valve 542 is controlled and a pulling operation of the arm 9 is performed, in such a manner as to realize an excavation speed, or excavation accuracy, required by the operator. In this instance, for enhancing the accuracy of excavation, the speed of the arm 9 may be reduced as required. In addition, in order that angle B of the bucket 10 relative to the target surface becomes a fixed value and leveling work is facilitated, the solenoid proportional valve 577 may be controlled such that the bucket is automatically rotated in the direction of arrow C.

In this instance, the work implement posture calculation section 30 calculates the posture of the front work implement 1B, based on information from the work implement posture sensor 34. The target surface calculation section 31 calculates the target surface, based on information from the target surface setting device 35. The target operation calculation section 32 calculates a target operation of the front work implement 1B such that the bucket 10 is moved without penetrating to below the target surface, based on information from the work implement posture calculation section 30 and the target surface calculation section 31. The solenoid valve control section 33 calculates control inputs to the solenoid shut-off valve 61 and the solenoid proportional valve 500, based on information from the target operation calculation section 32.

In the case of making the machine control invalid, the solenoid valve control section 33 gives an instruction to the solenoid shut-off valve 61 and the solenoid proportional valve 500 not to perform a control intervention. Specifically, the opening of the solenoid shut-off valve 61 is set to zero, such as to prevent the hydraulic fluid coming from the pilot pump 48 through the lock valve 51 from flowing into the hydraulic control unit 60. In addition, with respect to the solenoid proportional valves 532, 542, 552, 562, and 572 of which the openings are to be full open when no current is passed, the openings are set full open, such as not to intervene in the pilot pressure due to an operator's operation. Besides, with respect to the solenoid proportional valves 525, 567, and 577 of which the openings are to be zero when no current is passed, the openings are set to zero, such as to prevent the front work implement 1B to be operated without an operator's operation.

Figure 6:
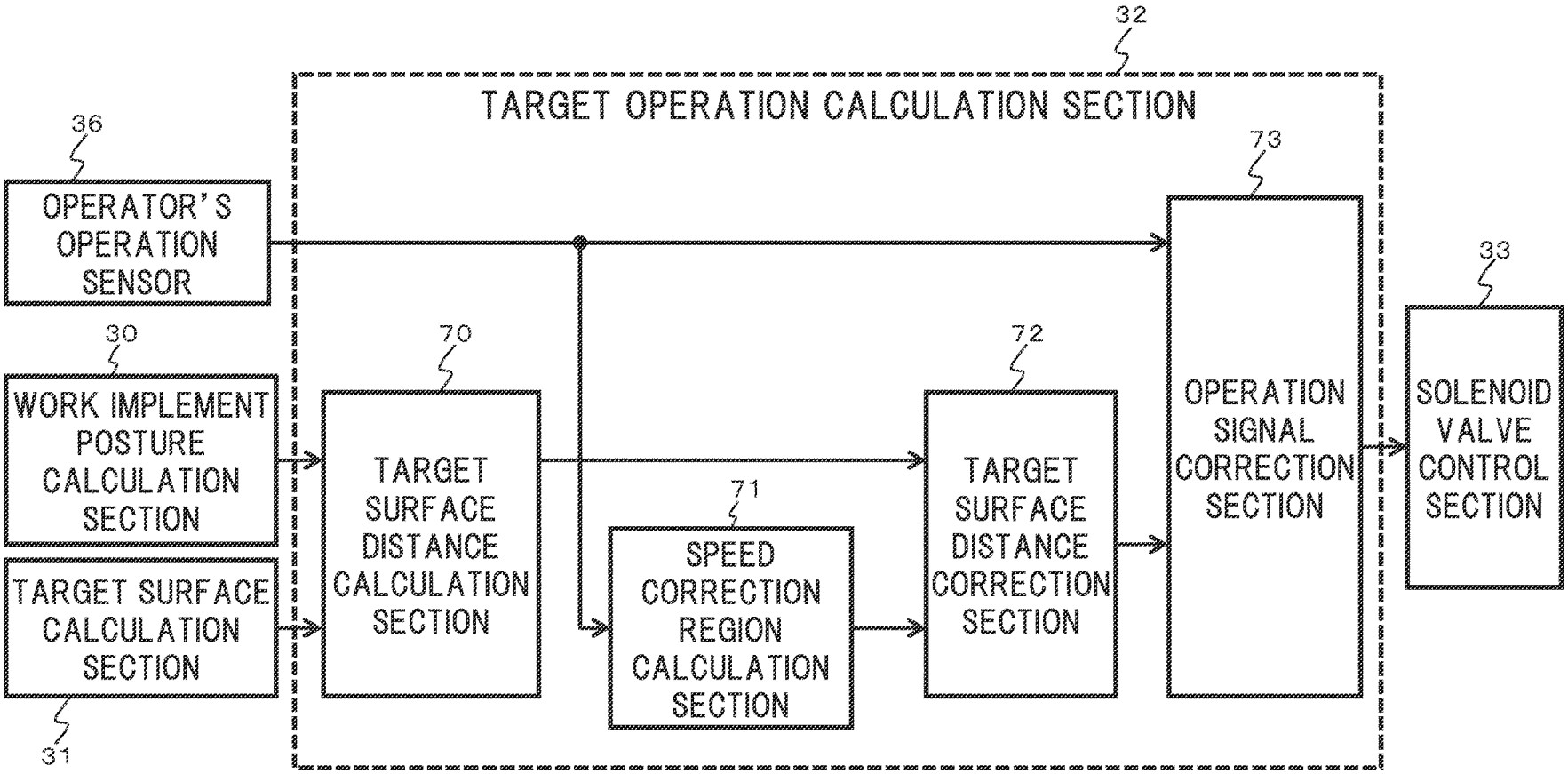
FIG. 6 is a functional block diagram of a target operation calculation section depicted in FIG. 4.

FIG. 6 is a functional block diagram of the target operation calculation section depicted in FIG. 5.

In FIG. 6, the target operation calculation section 32 includes a target surface distance calculation section 70, a speed correction region calculation section 71, a target surface distance correction section 72, and an operation signal correction section 73.

The target surface distance calculation section 70 calculates the distance from the tip of the bucket to a target surface (hereinafter referred to as target surface distance), based on a bucket tip position inputted from the work implement posture calculation section 30 and a target surface inputted from the target surface calculation section 31, and outputs the target surface distance to the target surface distance correction section 72.

The speed correction region calculation section 71 calculates a speed correction region width, which will be described later, based on the lever operation amount inputted from the operator's operation sensor 36, and outputs the speed correction region width to the target surface distance correction section 72.

The target surface distance correction section 72 calculate a corrected target surface distance based on a target surface distance inputted from the target surface distance calculation section 70 and a speed correction region width inputted from the speed correction region calculation section 71, and outputs the corrected target surface distance to the operation signal correction section 73.

The operation signal correction section 73 corrects an operation signal, inputted from the operator's operation sensor 36, based on the corrected target surface distance inputted from the target surface distance correction section 72, and outputs the corrected operation signal to the solenoid valve control section 33.

Figure 7:
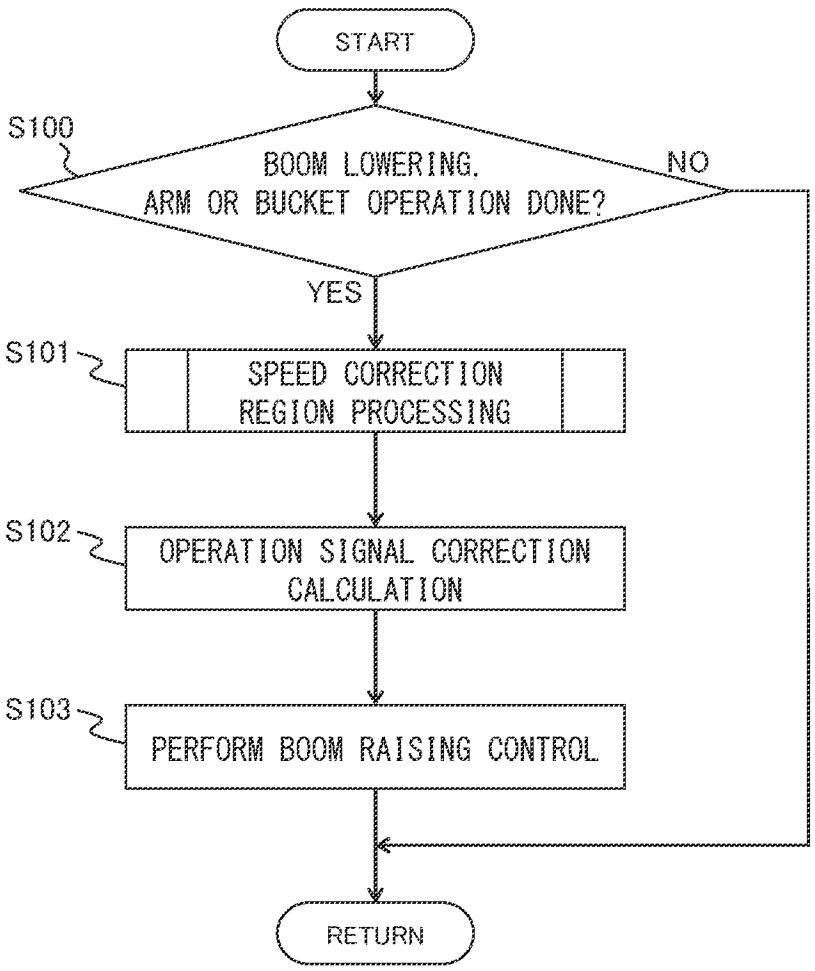
FIG. 7 is a flow chart depicting a processing of the target operation calculation section depicted in FIG. 6.

FIG. 7 is a flow chart depicting a processing of the target operation calculation section 32 depicted in FIG. 6. The steps will be sequentially described below.

First, in step S100, it is determined whether or not the boom operation lever 15*a* has been operated in a boom lowering direction, or whether or not the arm operation lever 15*c* or the bucket operation lever 15*b* has been operated.

When it is determined in step S100 that the boom operation lever 15*a* has been operated in the boom lowering direction or that the arm operation lever 15*c* or the bucket operation lever 15*b* has been operated (YES), a processing of setting a speed correction region on an upper side of the target surface (speed correction region processing) is conducted in step S101. The details of the speed correction region processing will be described later.

Subsequently to step S101, calculation for correcting the operation signal (operation signal correction calculation) is performed in step S102. The details of the operation signal correction calculation will be described later.

Subsequently to step S102, a boom raising control according to the operation signal corrected in step S102 is carried out in step S103.

Subsequently to step S103, or when the determination in step S100 is NO, the control returns to step S100.

Figure 8:
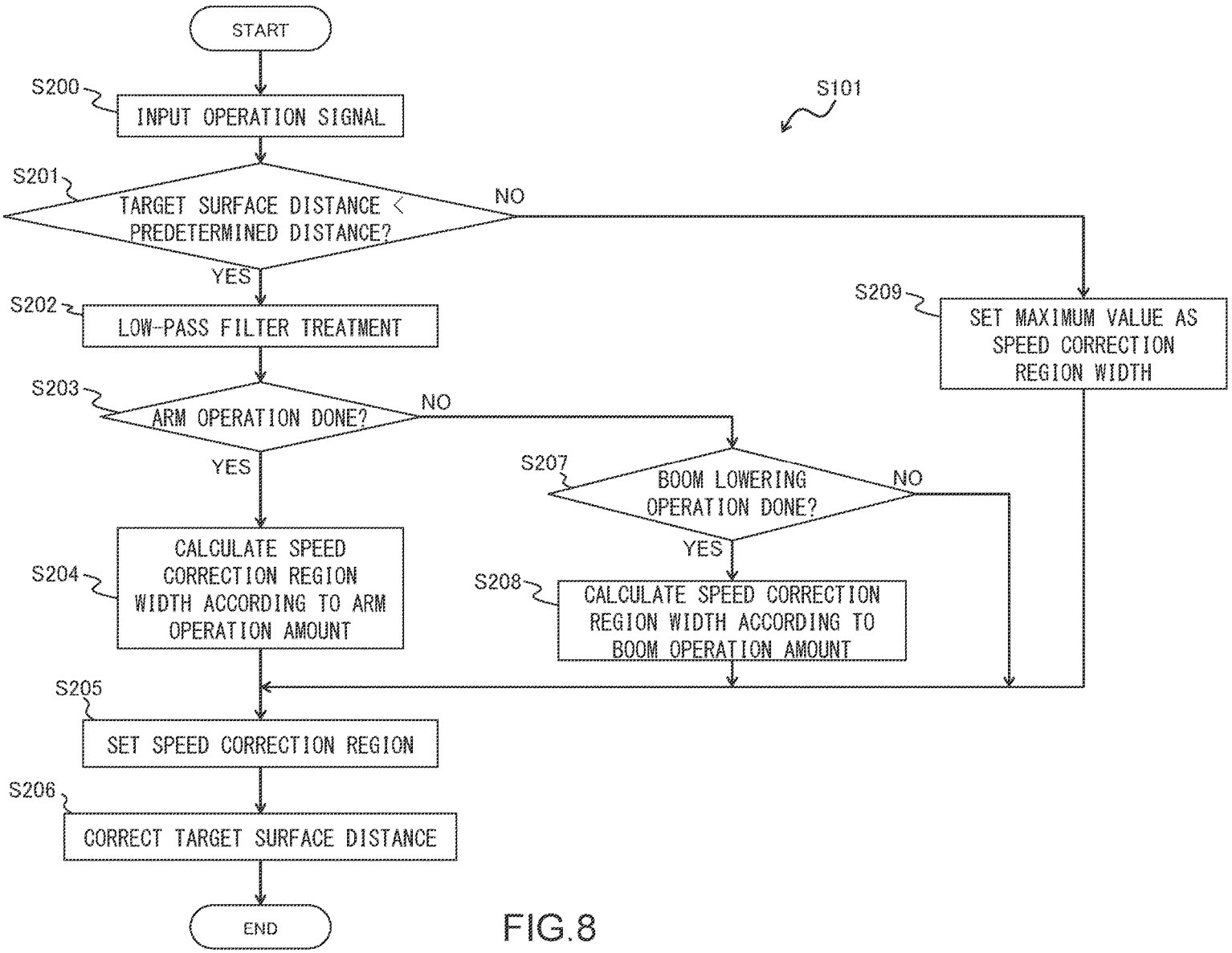
FIG. 8 is a flow chart depicting details of a speed correction region processing depicted in FIG. 7.

FIG. 8 is a flow chart depicting in detail the speed correction region processing (step S101) depicted in FIG. 7. The steps will be sequentially described below.

First, an operation signal is inputted in step S200.

Subsequently to step S200, whether or not the target surface distance is smaller than a predetermined distance is determined in step S201. Here, the predetermined distance is set to a value greater than a maximum value Rmax of a speed correction region width R which will be described later.

When it is determined in step S201 that the target surface distance is smaller than the predetermined distance (YES), the operation signals are subjected to a low-pass filter treatment with respect to the respective operation signals in step S202. As a result, high-frequency components of the operation signals are removed, and, therefore, sudden changes in the speed correction region width R, which will be described later, can be prevented.

Subsequently to step S202, whether or not the arm operation lever 15*c* has been operated is determined in step S203.

When it is determined in step S203 that the arm operation lever 15*c* has been operated (YES), a speed correction region width R corresponding to the operation amount of the arm operation lever 15*c* is calculated in step S204. Specifically, referring to a conversion table depicted in FIG. 9A, the speed correction region width R corresponding to the operation amount of the arm operation lever 15*c* is calculated. When the arm lever operation amount is equal to or less than a lower limit PAmin, the speed correction region width R is constant at zero. When the arm lever operation amount is between the lower limit PAmin and a predetermined upper limit PAmax, the speed correction region width R increases from zero to a predetermined maximum value Rmax, in proportion to the arm lever operation amount. When the arm lever operation amount is equal to or more than the upper limit PAmax, the speed correction region width R is constant at the maximum value Rmax.

When it is determined in step S203 that the arm operation lever 15*c* has not been operated (NO), whether or not the boom operation lever 15*a* has been operated in a boom lowering direction is determined in step S207.

When it is determined in step S207 that the boom operation lever 15*a* has been operated in the boom lowering direction (YES), a speed correction region width R corresponding to the operation amount in the boom lowering direction is calculated in step S208. Specifically, referring to a conversion table depicted in FIG. 9B, the speed correction region width R corresponding to the operation amount of the boom operation lever 15*a* in the boom lowering direction is calculated. When the operation amount in the boom lowering direction is equal to or less than a predetermined lower limit PBDmin, the speed correction region width R is constant at zero. When the lever operation amount in the boom lowering direction is between the lower limit PBDmin and a predetermined upper limit PBDmax, the speed correction region width R increases from zero to a predetermined maximum value Rmax, in proportion to the lever operation amount in the boom lowering direction. When the boom lowering lever operation amount is equal to or more than the upper limit PBDmax, the speed correction region width R is constant at the maximum value Rmax.

When it is determined in step S201 that the target surface distance is equal to or greater than the predetermined distance (NO), the maximum value Rmax is set as the speed correction region width R in step S209. This ensures that in the case where the bucket 10 is largely spaced from the target surface, an upper surface of the speed correction region is set higher than the target surface by the speed correction region width Rmax, irrespectively of the operator's lever operation. As a result, for example, even in the case where the bucket 10 is moved at high speed from a remote position toward the target surface and where setting of the speed correction region width R is too late due to a delay in calculation by the controller 20, the tip of the bucket can be prevented from penetrating to below the target surface.

Subsequently to step S204, S208, or S209, or when it is determined in step S207 that the boom operation lever 15*a* has not been operated in the boom lowering direction (NO), setting of a speed correction region is conducted in step S205. Specifically, a speed correction region having the speed correction region width calculated in step S204, S208, or S209 is set on the upper side of the target surface.

Figure 10:
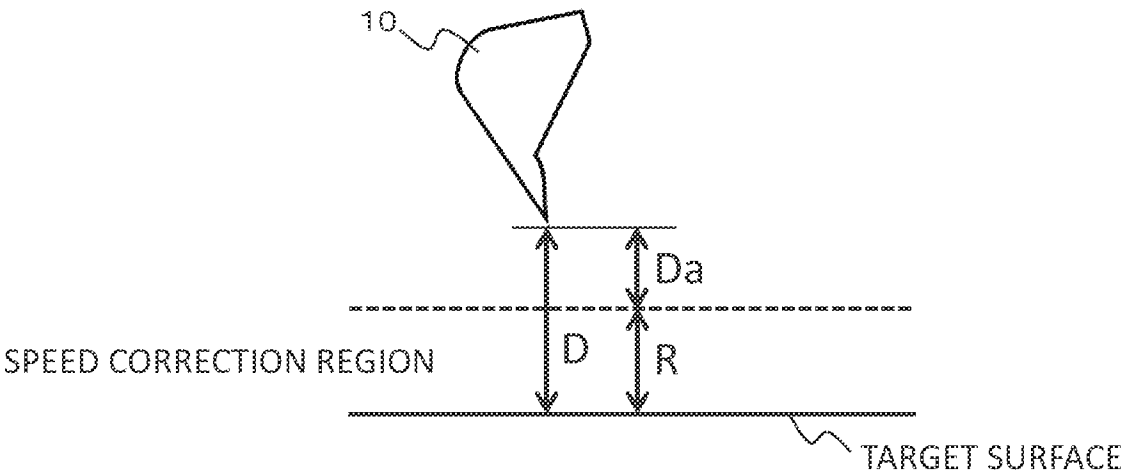
FIG. 10 is a figure depicting the relation between target surface distance and corrected target surface distance.

Subsequently to step S205, correction of a target surface distance D is conducted in step S206. Specifically, as depicted in FIG. 10, the speed correction region width R calculated in step S204, S208, or S209 is subtracted from the target surface distance D, to calculate a corrected target surface distance Da. This ensures that when the speed correction region width R is zero, machine control is carried out with the target surface as a reference, whereas when the speed correction region width R is greater than zero, machine control is carried out with the speed correction region upper surface set higher than the target surface by the speed correction region width R as a reference.

Figure 11:
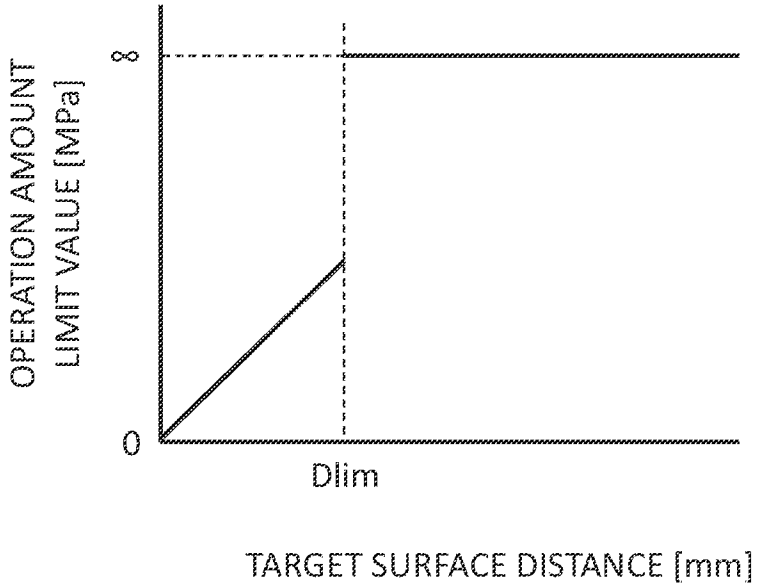
FIG. 11 is a diagram depicting the relation between target surface distance and operation amount limit value.

Subsequently to step S206, an operation signal correction calculation is conducted in step S102 depicted in FIG. 7. Specifically, the operation signal inputted in step S200 is corrected, based on the corrected target surface distance Da calculated in step S206. Here, as an example, a case of correcting the boom lowering pilot pressure which is one of the operation signals will be described. FIG. 11 is a diagram depicting the relation between target surface distance and operation amount limit value. The boom lowering pilot pressure is compared with an operation amount limit value set according to the target surface distance; when the boom lowering pilot pressure is greater than the operation amount limit value, it is corrected to coincide with the operation amount limit value. In FIG. 11, for a target surface distance equal to or smaller than a predetermined distance Dlim, an operation amount limit value proportional to the target surface distance is set, and, for a target surface distance greater than the predetermined distance Dlim, infinity is set as the operation amount limit value. Therefore, when the target surface distance Da is equal to or smaller than the predetermined distance Dlim, the operation signal is corrected such that the boom lowering pilot pressure is equal to or less than the operation amount limit value, and, when the target surface distance is greater than the predetermined distance Dlim, the operation signal is not corrected. As a result, when the target surface distance (or the corrected target surface distance) is less than the predetermined distance Dlim, the boom lowering operation is decelerated as the bucket tip approaches the target surface (or the upper surface of the speed correction region), and, therefore, the bucket tip can be prevented from penetrating to below the target surface (or into the speed correction region).

An operation of the hydraulic excavator 1 will be described below.

<Bucket Aligning Operation>

Figure 12:
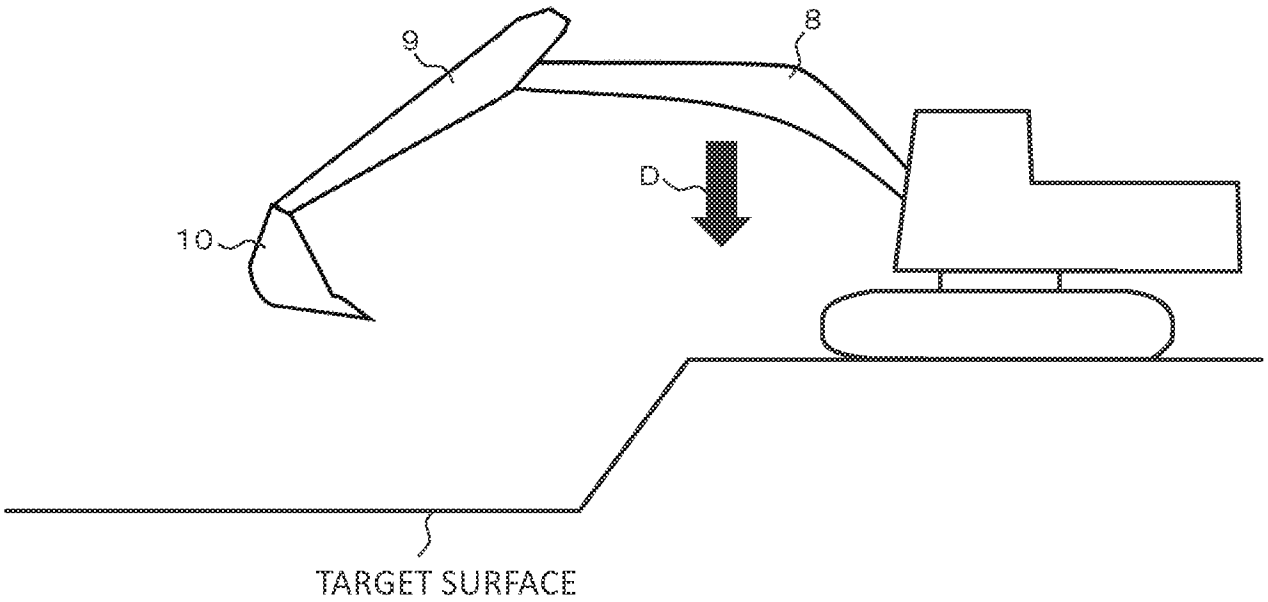
FIG. 12 is a figure depicting a bucket positioning operation of the hydraulic excavator depicted in FIG. 1.

As depicted in FIG. 12, a bucket aligning operation is carried out by operating the boom 8 in a lowering direction (the direction of arrow D) until the tip of the bucket 10 is disposed on the target surface.

Figure 9A:
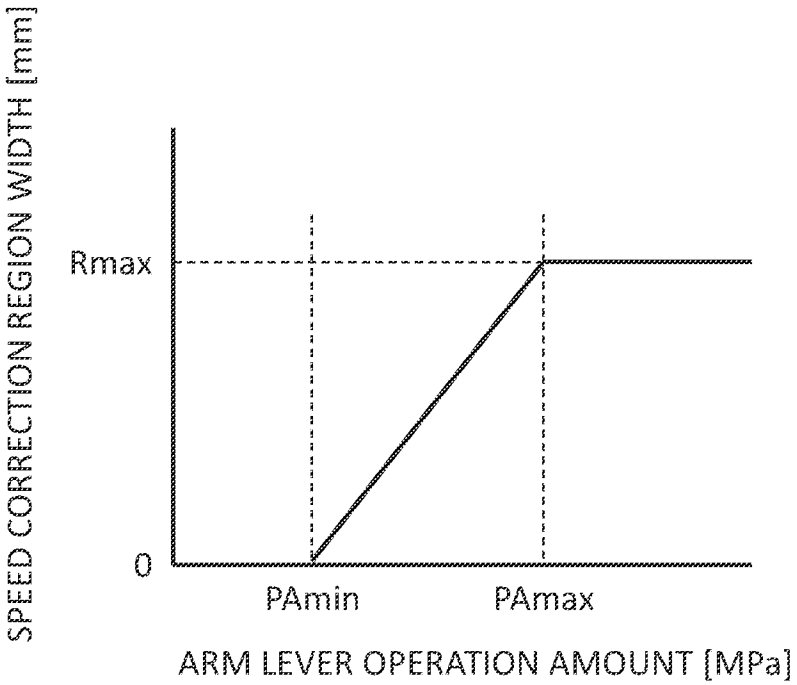
FIG. 9A is a diagram depicting the relation between arm lever operation amount and speed correction region width.
Figure 9B:
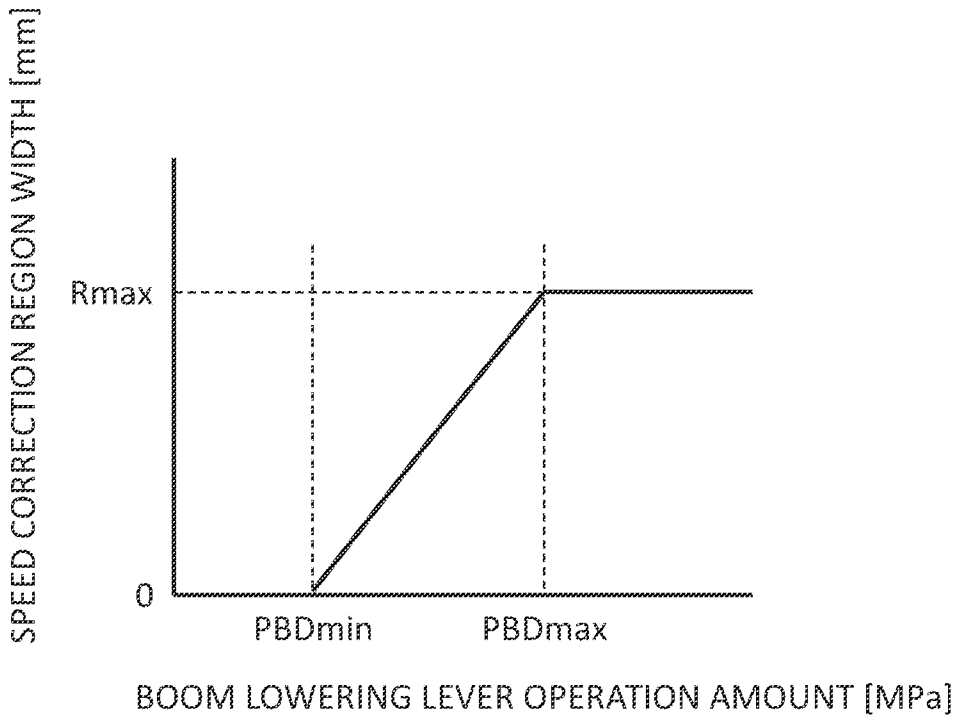
FIG. 9B is a diagram depicting the relation between boom lowering lever operation amount and speed correction region width.
Figure 13:
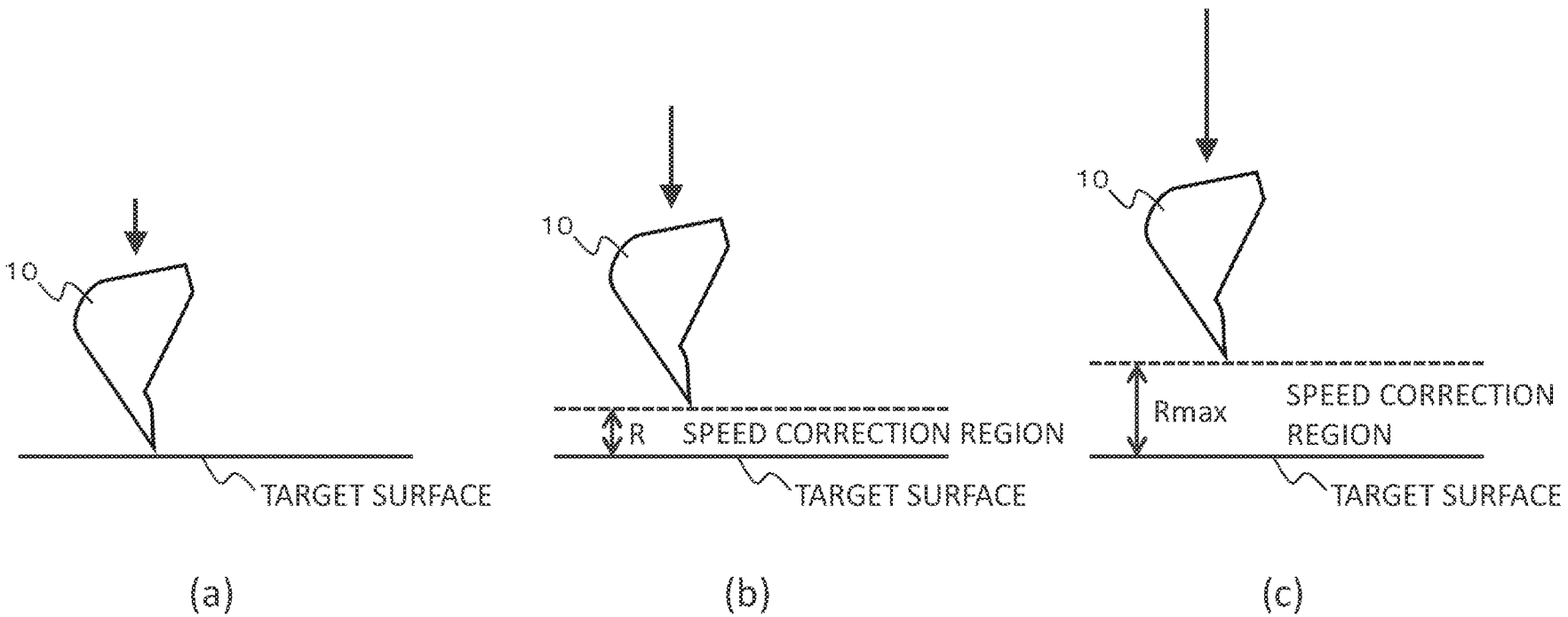
FIG. 13 illustrates figures depicting movements of a bucket with respect to a boom lowering operation.

When an operation amount of the boom operation lever 15*a* in a boom lowering direction is equal to or less than PBDmin, zero is set as the speed correction region width R based on the conversion table depicted in FIG. 9B, and, therefore, the corrected target surface distance Da coincides with the target surface distance D. As a result, when the tip of the bucket 10 is largely spaced from the target surface, the boom lowering operation is conducted at a speed according to the operation amount of the boom operation lever 15*a* in the boom lowering direction. As the tip of the bucket 10 approaches the target surface, the boom lowering pilot pressure is reduced in such a manner that the distance from the tip of the bucket 10 to the target surface (target surface distance D) does not become less than zero. In this instance, the operation amount of the boom operation lever 15*a* is equal to or less than the lower limit PBDmin, and the boom lowering speed is low; therefore, the accuracy of machine control is maintained, and the bucket 10 can be stopped when the tip of the bucket 10 comes to be located on the target surface, as depicted in FIG. 13(*a*).

When the operation amount of the boom operation lever 15*a* in the boom lowering direction is between the lower limit PBDmin and the upper limit PBDmax, a value in the range of zero to the maximum value Rmax is set as the speed correction region width R in accordance with the operation amount, and the corrected target surface distance Da is smaller than the target surface distance D by the speed correction region width R. As a result, when the tip of the bucket 10 is largely spaced from the speed correction region upper surface (indicated by broken line in the figure), the boom lowering operation is performed at a speed according to the operation amount of the boom operation lever 15*a* in the boom lowering direction. When the tip of the bucket 10 approaches the speed correction region upper surface, the boom lowering pilot pressure is reduced in such a manner that the distance from the tip of the bucket 10 to the speed correction region upper surface (corrected target surface distance Da) does not become less than zero. As a result, the boom lowering operation is stopped in a state in which the bucket tip is disposed on the speed correction region upper surface, as depicted in FIG. 13(*b*). In this instance, since the operation amount of the boom operation lever 15*a* is larger than the lower limit PBDmin and the boom lowering speed is not small, the accuracy of machine control may not be maintained, and the bucket tip may penetrate into the speed correction region. However, since the speed correction region upper surface is set higher than the target surface by the speed correction region width R according to the operation amount of the boom operation lever 15*a* in the boom lowering direction (that is, the boom lowering speed), the bucket tip can be prevented from penetrating to below the target surface.

When the operation amount of the boom operation lever 15*a* in the boom lowering direction is equal to or more than PBDmax, the maximum value Rmax is set as the speed correction region width R, and, therefore, the corrected target surface distance Da is smaller than the target surface distance D by the speed correction region width Rmax. As a result, when the tip of the bucket 10 is largely spaced from the speed correction region upper surface, the boom lowering operation is conducted at a speed according to the operation amount of the boom operation lever 15*a* in the boom lowering direction. When the tip of the bucket 10 approaches the speed correction region upper surface, the boom lowering pilot pressure is reduced in such a manner that the distance from the tip of the bucket 10 to the speed correction region upper surface (corrected target surface distance Da) does not become less than zero. As a result, as depicted in FIG. 12(*c*), the boom lowering operation is stopped in a state in which the bucket tip is disposed on the speed correction region upper surface. In this instance, since the operation amount of the boom operation lever 15*a* is equal to or more than the upper limit PBDmax and the boom lowering speed is high, the accuracy of machine control may not be maintained, and the bucket tip may penetrate into the speed correction region. However, since the speed correction region upper surface is set higher than the target surface by the speed correction region width Rmax according to the operation amount of the boom operation lever 15*a* in the boom lowering direction (that is, the boom lowering speed), the bucket tip can be prevented from penetrating to below the target surface. Note that the bucket tip cannot be moved into the speed correction region during when the operation amount in the boom lowering direction is larger than the lower limit PBDmin, but, by reducing the operation amount in the boom lowering direction to the lower limit PBDmin, the bucket tip can be made to reach the target surface.

<Horizontal Excavating Operation>

Figure 14:
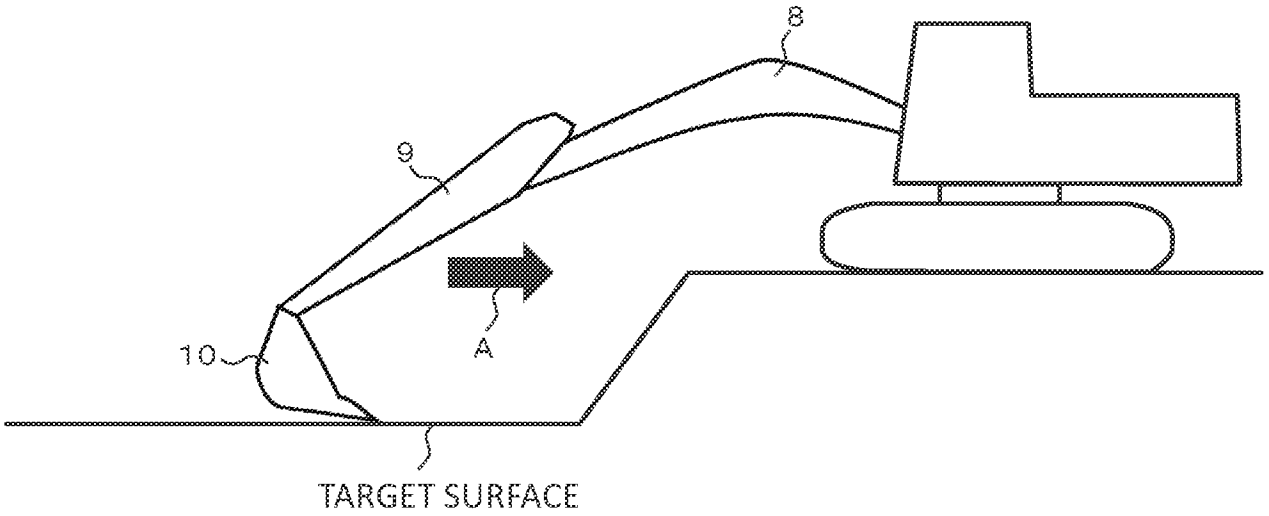
FIG. 14 is a figure depicting a horizontal excavating operation of the hydraulic excavator depicted in FIG. 1.

A horizontal excavating operation is performed by operating the arm 9 in a crowding direction (the direction of arrow B) in a state in which the tip of the bucket 10 is disposed on the target surface, as depicted in FIG. 14.

Figure 15:
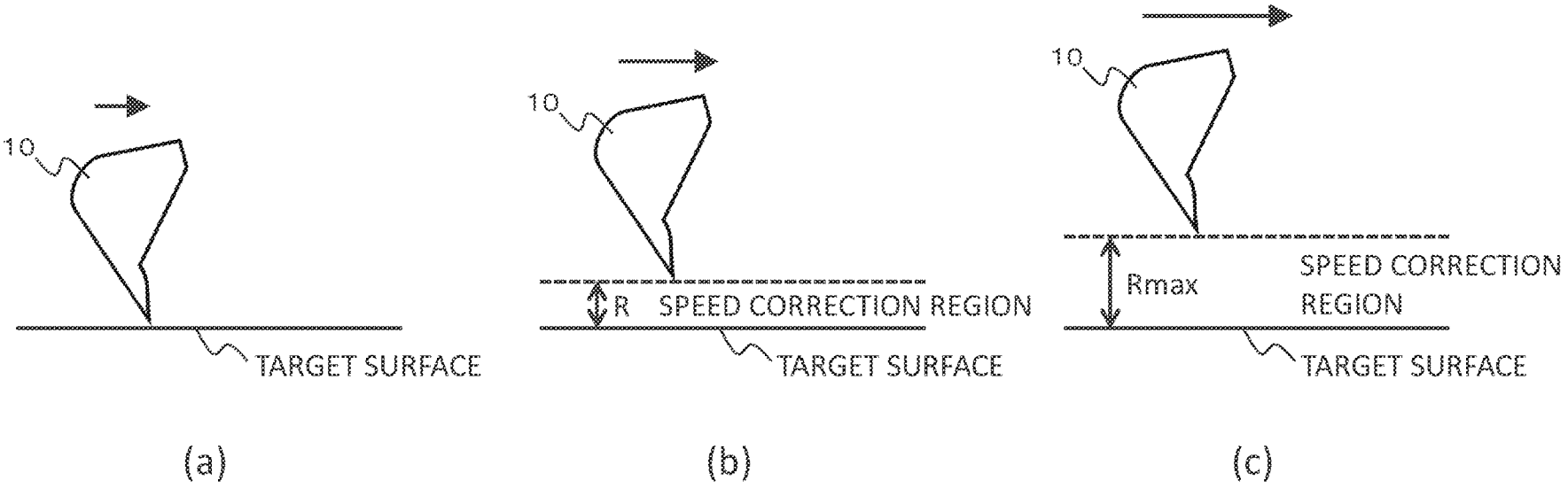
FIG. 15 illustrates figures depicting movements of the bucket with respect to an arm crowding operation.

When the operation amount of the arm operation lever 15*c* in an arm crowding direction is equal to or less than a lower limit PAmin, zero is set as the speed correction region width R based on the conversion table depicted in FIG. 9A, and, therefore, the corrected target surface distance Da coincides with the target surface distance D. As a result, a boom raising operation is automatically conducted in such a manner that the bucket 10 is moved at a speed according to the operation amount of the arm operation lever 15*c*, and the bucket tip is moved along the target surface, as depicted in FIG. 15(*a*). In this instance, since the operation amount of the arm operation lever 15*c* is equal to or less than the lower limit PAmin and the arm crowding speed is low, the accuracy of machine control is maintained, and the bucket tip can be prevented from penetrating to below the target surface.

When the operation amount of the arm operation lever 15*c* is between the lower limit PAmin to an upper limit PAmax, a value in the range of zero to a maximum value Rmax is set as the speed correction region width R in accordance with the operation amount, and, therefore, the corrected target surface distance Da is smaller than the target surface distance D by the speed correction region width R. This ensures that a boom raising control is automatically conducted until the bucket tip is disposed on the speed correction region upper surface (indicated by broken line in the figure), and the boom raising operation is automatically performed in such a manner that the bucket 10 is moved at a speed according to the operation amount of the arm operation lever 15*c* and that the bucket tip is moved along the speed correction region upper surface located to be higher than the target surface by the speed correction region width R, as depicted in FIG. 15(*b*). In this instance, since the operation amount of the arm operation lever 15*c* is larger than the lower limit PAmin and the arm crowding speed is not low, the accuracy of machine control may not be maintained, and the bucket tip may penetrate into the speed correction region. However, since the speed correction region upper surface is set higher than the target surface by the speed correction region width R according to the operation amount of the arm operation lever 15*c* in the arm crowding direction (that is, the arm crowding speed), the bucket tip can be prevented from penetrating to below the target surface.

When the operation amount of the arm operation lever 15*c* in the arm crowding direction is equal to or more than the upper limit PAmax, the maximum value Rmax is set as the speed correction region width R, and, therefore, the corrected target surface distance Da is smaller than the target surface distance D by the speed correction region width Rmax. As a result, a boom raising control is automatically conducted until the bucket tip is disposed on the speed correction region upper surface, and the boom raising operation is automatically performed in such a manner that the bucket 10 is moved at a speed according to the operation amount of the arm operation lever 15*c* and that the bucket tip is moved along the speed correction region upper surface located to be higher than the target surface by the maximum correction amount Rmax, as depicted in FIG. 15(*c*). In this instance, since the operation amount of the arm operation lever 15*c* is equal to or more than the upper limit PAmax and the arm crowding speed is high, the accuracy of machine control may not be maintained, and the bucket tip may penetrate into the speed correction region. However, since the speed correction region upper surface is set higher than the target surface by the speed correction region width Rmax according to the operation amount of the arm operation lever 15*c* in the arm crowding direction (that is, the arm crowding speed), the bucket tip can be prevented from penetrating to below the target surface.

According to the hydraulic excavator 1 configured as above, when the operation amount of the operation device 15A or 15C is equal to or less than the predetermined operation amount PBDmin or PAmin, the operation of the front work implement 1B is controlled in such a manner that the distance from the bucket tip to the target surface (target surface distance D) does not become less than zero. On the other hand, when the operation amount of the operation device 15A or 15C is larger than the predetermined operation amount PBDmin or PAmin, the speed correction region upper surface is set higher than the target surface by the speed correction region width R according to the operation amount, and the operation of the front work implement 1B is controlled in such a manner that the distance from the bucket tip to the speed correction region upper surface (corrected target surface distance Da) does not become less than zero. As a result, it becomes possible to operate the front work implement 1B at a speed according to the operator's lever operation, while securing the accuracy of work by machine control.

While the embodiment of the present invention has been described in detail above, the present invention is not limited to the above embodiment, but include various modifications. For instance, while the hydraulic excavator 1 having the bucket 10 has been described as an example of the work tool in the above embodiment, the present invention is applicable to hydraulic excavators having other work tool than the bucket, and to other work machines than the hydraulic excavator. In addition, while a case of performing machine control with respect to the position of the tip of the bucket 10 has been described in the above embodiment, the present invention is applicable also to a case of performing machine control with respect other position of the bucket 10. Besides, while cases of correcting the target surface distance D according to the operation amount of the boom operation lever 15*a* in the boom lowering direction and the operation amount of the arm operation lever 15*c* have been described in the above embodiment, the target surface distance D may be corrected according to the operation amount of the bucket operation lever 15*b*. In addition, the above embodiment has been described in detail for easily understandably explaining the present invention, and the present invention is not limited to an embodiment that has all the above-described configurations.

Description of Reference Characters

1: Hydraulic excavator
1A: Machine body
1B: Front work implement
1C: Operation room
2: Hydraulic pump
4: Swing hydraulic motor
5: Boom cylinder
6: Arm cylinder
7: Bucket cylinder
8: Boom
9: Arm
10: Bucket
11: Lower track structure
12: Upper swing structure
13*a*: Track right lever
13*b*: Track left lever
14*a*: Operation right lever
14*b*: Operation left lever
15A to 15D: Operation device
15*a*: Boom operation lever
15*b*: Bucket operation lever
15*c*: Arm operation lever
15*d*: Swing operation lever
16*a*: Boom flow control valve
16*b*: Bucket flow control valve
16*c*: Arm flow control valve
16*d*: Swing flow control valve
20: Controller
21: Boom angle sensor
22: Arm angle sensor
23: Bucket angle sensor
24: Machine body inclination angle sensor
30: Work implement posture calculation section
31: Target surface calculation section
32: Target operation calculation section
33: Solenoid valve control section
34: Work implement posture sensor
35: Target surface setting device
36: Operator's operation sensor
46: Shuttle block
47: Regulator
48: Pilot pump
49: Prime mover
50: Tank
51: Lock valve
52: Boom raising pilot pressure control valve
53: Boom lowering pilot pressure control valve
54: Bucket crowding pilot pressure control valve
55: Bucket dumping pilot pressure control valve
56: Arm crowding pilot pressure control valve
57: Arm dumping pilot pressure control valve
58: Right swing pilot pressure control valve
59: Left swing pilot pressure control valve
60: Hydraulic control unit
61: Solenoid shut-off valve
70: Target surface distance calculation section
71: Speed correction region calculation section
72: Target surface distance correction section
73: Operation signal correction section
100: Hydraulic drive system
500: Solenoid proportional valve
521: Pilot line
522: Shuttle valve
523: Pilot line
524: Pilot line
525: Solenoid proportional valve
526: Pressure sensor
529: Pilot line
531: Pilot line
532: Solenoid proportional valve
533: Pilot line
534: Pressure sensor
539: Pilot line
541: Pilot line
542: Solenoid proportional valve
543: Pilot line
544: Pressure sensor
549: Pilot line
551: Pilot line
552: Solenoid proportional valve
553: Pilot line
554: Pressure sensor
559: Pilot line
561: Pilot line
562: Solenoid proportional valve
563: Pilot line
564: Shuttle valve
565: Pilot line
566: Pilot line
567: Solenoid proportional valve
568: Pressure sensor
569: Pilot line
571: Pilot line
572: Solenoid proportional valve
573: Pilot line
574: Shuttle valve
575: Pilot line
576: Pilot line
577: Solenoid proportional valve
578: Pressure sensor
579: Pilot line
589: Pilot line
599: Pilot line.

The invention claimed is:

1. A work machine comprising:

a machine body;

an articulated-type work implement including a boom rotatably mounted to the machine body, an arm rotatably mounted to a tip portion of the boom, and a work tool rotatably mounted to the arm;

a boom cylinder configured to drive the boom;

an arm cylinder configured to drive the arm;

a work tool cylinder configured to drive the work tool;

an operation device that expands and contracts the boom cylinder, the arm cylinder, and the work tool cylinder at a speed according to an operation amount, and outputs an operation signal for operating the work implement; and a controller configured to:

set a target surface for the work tool, and control an operation of the work implement in such a manner that the work tool does not penetrate to below the target surface, set a speed correction region on an upper side of the target surface, when an operation amount of the operation device for outputting an operating signal for operating the boom in a lowering direction or an operating signal for operating the arm in a crowding direction is larger than a predetermined lower limit, decrease a width of the speed correction region as the operation amount of the operation device for outputting the operating signal for operating the work implement decreases, and control the operation of the work implement in such a manner that the work tool does not penetrate into the speed correction region, and when the operation amount of the operation device for outputting the operating signal for operating the boom in the lowering direction or the operating signal for operating the arm in the crowding direction is equal to or less than the predetermined lower limit, set the width of the speed correction region to zero and control the operation of the work implement in such a manner that the work tool does not penetrate to below the target surface.

2. The work machine according to claim 1, wherein the controller includes:

a target surface distance calculation section configured to calculate a target surface distance that is a distance from the work tool to the target surface;

a speed correction region calculation section configured to vary a width of the speed correction region from zero to a predetermined maximum value in accordance with an operation amount of the operation device; and a target surface distance correction section configured to correct the target surface distance by subtracting the width of the speed correction region from the target surface distance.

3. The work machine according to claim 2, wherein the speed correction region calculation section is configured to set the width of the speed correction region to the predetermined maximum value irrespectively of an operation amount of the operation device when the target surface distance is larger than a predetermined distance set to be larger than the predetermined maximum value.

4. The work machine according to claim 2, wherein the speed correction region calculation section is configured to subject an operation amount of the operation device to a low-pass filter treatment.

* * * * *